US006489926B2

(12) United States Patent
Jarvis et al.

(10) Patent No.: US 6,489,926 B2
(45) Date of Patent: Dec. 3, 2002

(54) ANTENNA FOR HAND-HELD COMMUNICATIONS DEVICES TO REDUCE EXPOSURE TO ELECTROMAGNETIC RADIATION

(76) Inventors: Gary A Jarvis, 300 E. 40th St. 25 W., New York, NY (US) 10016; Ian D Jarvis, 300 E. 40th St. 25 W., New York, NY (US) 10016

( * ) Notice: Subject to any disclaimer, the term of this patent is extended or adjusted under 35 U.S.C. 154(b) by 24 days.

(21) Appl. No.: 09/782,483

(22) Filed: Feb. 13, 2001

(65) Prior Publication Data

US 2002/0109640 A1 Aug. 15, 2002

(51) Int. Cl.[7] ..... H01Q 1/24
(52) U.S. Cl. ..... 343/702; 343/841
(58) Field of Search ..... 343/702, 900, 343/901, 872, 841, 874, 873; 455/90, 89

(56) References Cited

U.S. PATENT DOCUMENTS 2,480,143 A * 8/1949 Lanxner ..... 250/33.65
6,369,774 B1 * 4/2002 Lucidarme ..... 343/890

* cited by examiner

*Primary Examiner*—Don Wong
*Assistant Examiner*—James Clinger

(57) ABSTRACT

An antenna for a communications device with a design to minimize human exposure to emitted electromagnetic energy. The antenna incorporates a shield wall and directing buds having the property of reflecting, deflecting or absorbing RF frequency waves. The shield wall and directing buds direct transmitted communication signals away from the immediate user and other bystanders in the vicinity of the communications device while simultaneously directing a stronger signal towards a receiver. Alternative embodiments of the antenna include the ability to extend or swivel. These features allow the antenna to be positioned to maximize transmission/reception while simultaneously minimizing human exposure.

33 Claims, 7 Drawing Sheets

FIG. 1
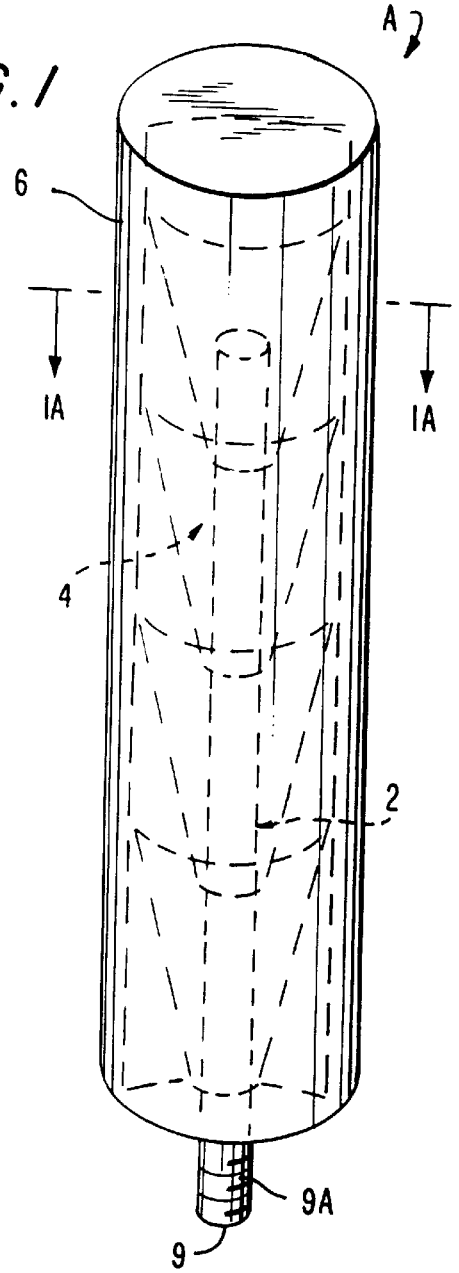
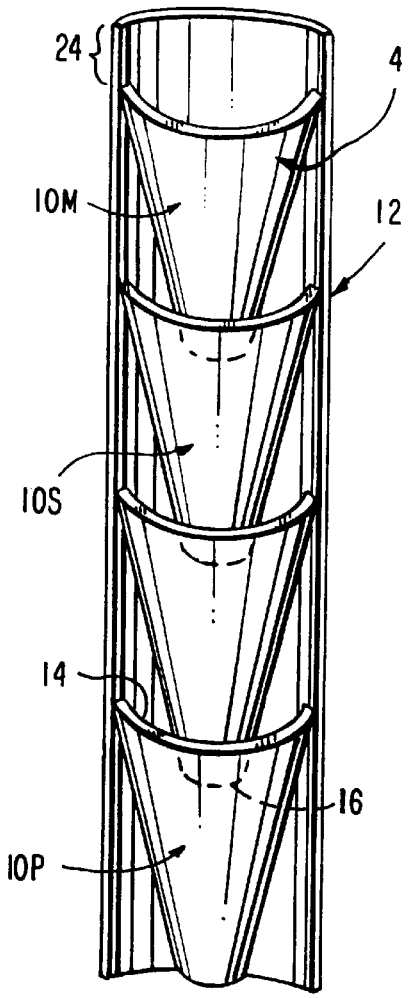
FIG. 7
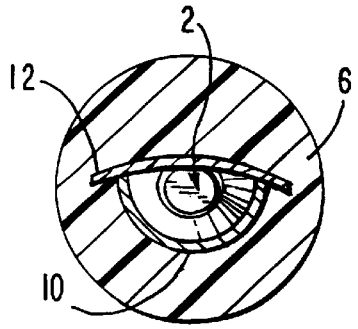
FIG. 1A

FIG. 4A
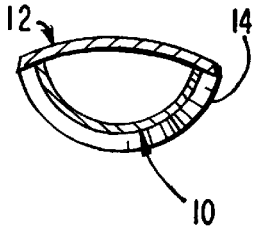
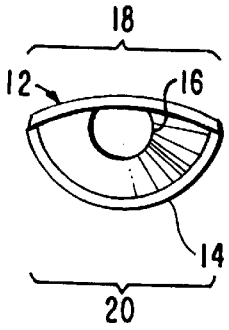
FIG. 6
FIG. 8A
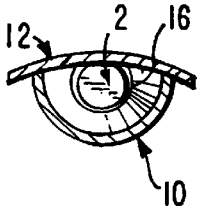
FIG. 3
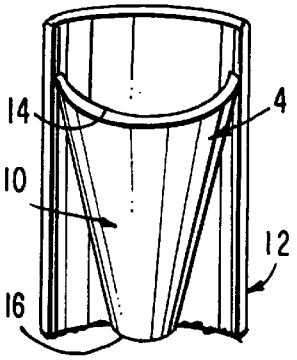
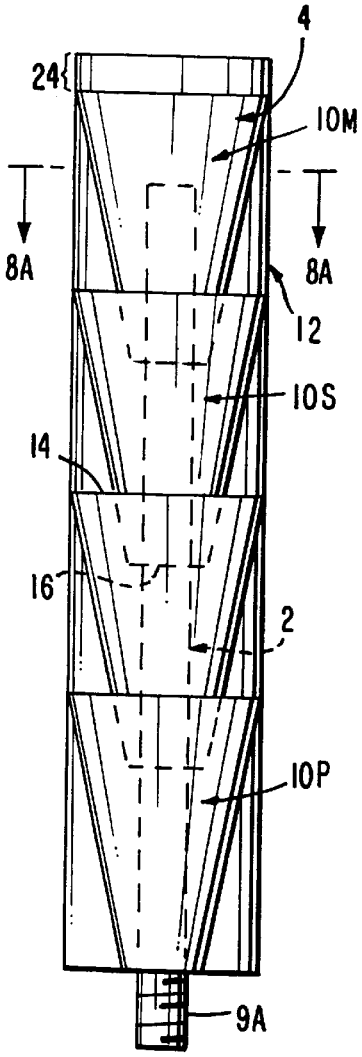
FIG. 8
FIG. 4
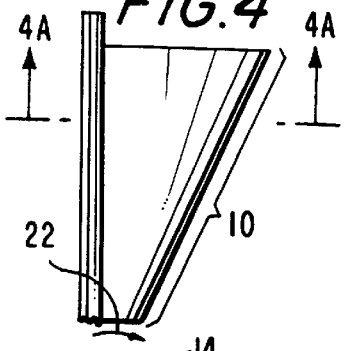
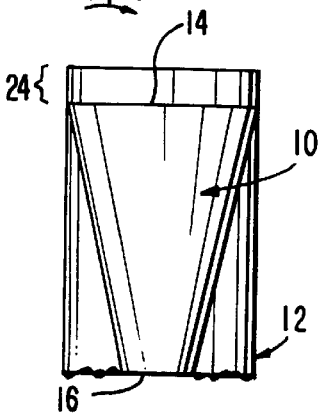
FIG. 5
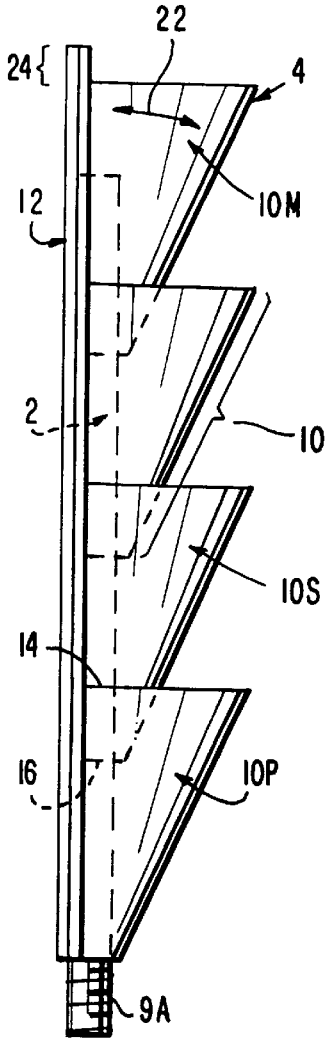
FIG. 9

ANTENNA FOR HAND-HELD COMMUNICATIONS DEVICES TO REDUCE EXPOSURE TO ELECTROMAGNETIC RADIATION

FIELD OF THE INVENTION

This invention relates to antennas used on portable devices. More specifically, the invention involves the design of an antenna for a portable transceiver device to reduce the exposure of its user and bystanders to electromagnetic transmissions emitted from the device.

BACKGROUND OF THE INVENTION

Technological progress in the field of electronics has broadened the availability of affordable yet sophisticated portable communication devices. For example, consider the cell or wireless phone. Such transceiver devices provide users with the convenient ability to talk with associates, family and friends even while on the move. More recently, these devices have offered users the ability to send and receive digital information including electronic mail and even surf the Internet from almost any location. Thus, it is no surprise that the devices are widely used. Moreover, while the number of present users of such devices is staggering, with new advancements and improvements, the numbers will only continue to grow.

However, increased convenience should not come at the cost of personal safety. In recent years, the proliferation of such devices has generated some cause for concern. Since each transceiver device requires the ability to transmit information to some external location without the use of a physical channel or wire, each device must be equipped with a radio-frequency (RF) transmitter. Typically, these RF transmitters generate Ultra High Frequency (UHF) electromagnetic carrier waves in the region of 300 to 3000 MHz. Since these waves emanate from these devices in close proximity to their users and bystanders, the potential negative health effects of UHF radiation exposure has entered the public arena. For example, the effect of UHF radiation as a cause of cancer is addressed in JE Moulder et al: Cell Phones and Cancer: What Is the Evidence for a Connection? Radiation Research 151(5):513–531, May 1999; see also KR Foster and JE Moulder: Are mobile phones safe? IEEE Spectrum, August 2000, p. 23–28.

At least one prior art antenna has attempted to minimize the risks of cancer due to the exposure to RF radiation transmitted from a hand-held communications device. In the patent to Chang, U.S. Pat. No. 6,097,340, an antenna with a semi-cylindrical shield is used to limit the direction of radiating RF waves of a cell phone. The shield is intended to cover the side of the core of the antenna that faces the cell phone user. However, the antenna has an important shortfall. The antenna provides only limited protection. As designed, the antenna provides no shielding for non-users of the phone who are still in close proximity to the RF radiation from the side of the core opposite the shield.

BRIEF DESCRIPTION OF THE INVENTION

An objective of the present invention is to provide an antenna for a portable communications device that reduces the user's exposure to RF radiation emitted from the device.

A further objective of the present invention is to provide an antenna for a portable communications device that reduces bystanders' exposure to RF radiation emitted from the device.

A still further objective of the present invention is to provide such an antenna while maintaining the antenna's effectiveness.

An additional objective is to provide an antenna with improved signal transmission capabilities.

Additional objectives will be apparent from the description of the invention as contained herein.

In its broadest aspects, the present invention involves an antenna for hand-held communications devices such as a cell phone, beeper, portable computer/organizer with RF transmission capabilities, portable Internet access device or other transmitter emitting RF radiation. In its preferred embodiment, the antenna utilizes a unique directing shield with a design intended to minimize RF radiation exposure by users and bystanders in close proximity to the device while simultaneously maximizing directional transmission toward the intended receiver of the signal. In general, the directing shield combines a concave shield wall with one or more semi-conic buds. The shield wall and semi-conic buds are treated with or molded from a transmission blocking/reflecting material. The directing shield is positioned over a linear cylindrical rod or conducting member of the antenna. The combined directing shield and conducting member are encased by a resin or plastic shell. The conducting member extends from the encasing for connection to RF transmission circuitry of a communications device.

In one embodiment of the invention, the antenna is configured with a bend angle to maximize transmission in the desired direction and away from its user and bystanders. while the portable device is in use. In another embodiment, the antenna has a collapsible/extendible portion to allow the antenna to be raised and lowered. In a further embodiment, the antenna can swivel at its base so that the directional alignment of the bud or buds may be adjusted when the portable device is used in alternative positions.

BRIEF DESCRIPTION OF THE DRAWINGS

The figures are presented with this disclosure are for illustrative purposes only and are not drawn to scale. As such, they are not intended as a limitation on the scope of the invention as specified in the following detailed description.

FIG. 1 is a plan view of the side profile of an antenna of the present invention;

FIG. 1A is a cross-section of the antenna of FIG. 1 taken along the line 1A—1A.

FIG. 3 is an elevational view of a directing shield with a single semi-conic bud taken from a point of view above and in front;

FIG. 4 is a plan view of the left side of the shield of FIG. 3;

FIG. 4A shows a cross-section of the single bud directing shield of FIG. 3 taken along line 4A—4A of FIG. 4;

FIG. 5 is a front plan view of the shield of FIG. 3;

FIG. 6 is a top plan view of the shield of FIG. 3;

FIG. 7 is an elevational view of a directing shield with multiple buds taken from the point of view above and in front;

FIG. 8 is a front view of the shield of FIG. 7 with a conducting rod;

FIG. 8A shows a the directing shield of FIG. 8 taken along line 8A—8A of FIG. 8;

FIG. 9 is a side view of the shield of FIG. 7 with a conducting rod;

DETAILED DESCRIPTION OF THE INVENTION

Figure 2:
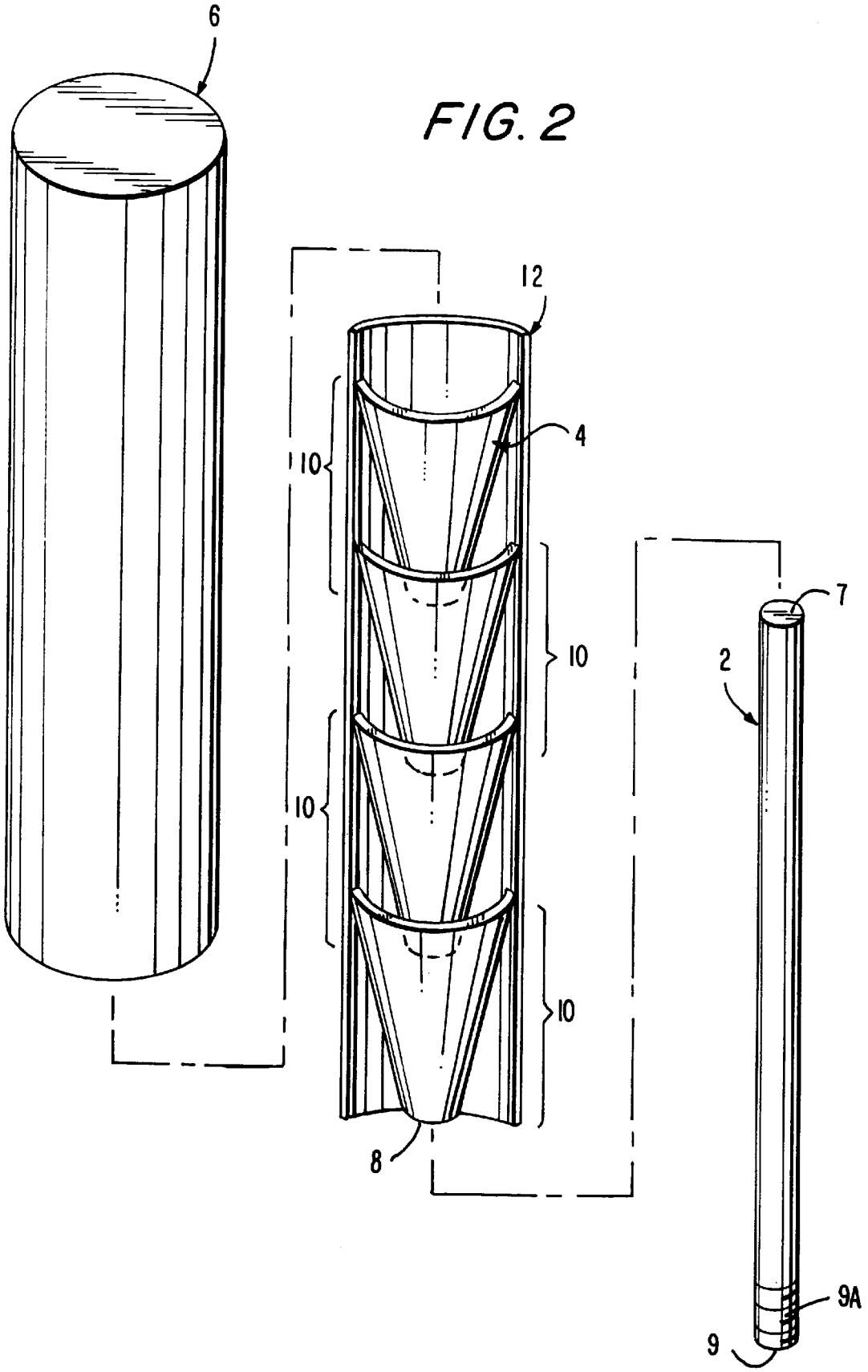
FIG. 2 is an exploded elevational view of the antenna of FIG. 1.

Referring to FIGS. 1 and 2, an antenna A made in accordance with the present invention can be generally described as having three parts. The antenna A has an outer shell 6, a directing shield 4 and a conducting rod 2.

Figure 16:
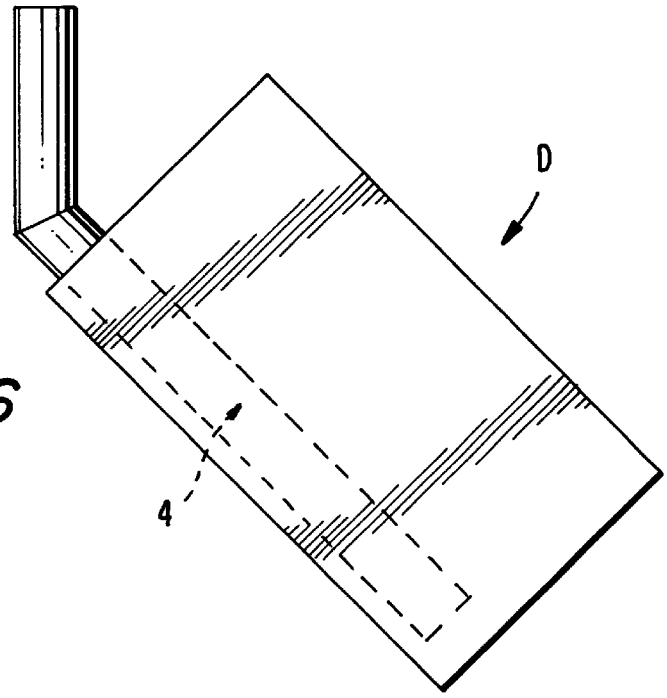
FIG. 16 shows one embodiment of the antenna within a communications device.

The conducting rod 2 serves the purpose of sending an RF signal from the communications device. The rod 2 may also serve as the means for receiving externally transmitted RF signals. Although the conductor used in the antenna is referred to as a rod 2, any conducting member of an alternative shape may be used if it can be placed within the directing shield 4. Generally, the rod 2 has a tip portion 7 and a base portion 9. The rod 2 is connected to the circuit of the communications device typically at the base portion 9. In the embodiment depicted in FIG. 1, the base portion 9 of the rod uses. a threaded connector 9A to attach to the circuit. The connector will allow the transfer of current between the rod 2 and the transmitter/receiver circuit of the communications device. To this end, there are many alternative means for connecting the rod 2 to a communications device, which will be obvious to one skilled in the field. In one embodiment of the invention, seen in FIG. 16, the rod 2 and the directing shield 4 may extend into the shell or casing of the communications device D.

FIGS. 2 through 9 show two embodiments of a directing shield 4 constructed in accordance with the present invention. FIGS. 3 through 6 show the single bud version and FIGS. 2 and 7 through 9 show a multi-bud version. The directing shield 4 provides a means to reduce user and bystander exposure to generated electromagnetic waves. The directing shield 4 includes a shield wall 12 and one or more semi-conic buds 10. The shield wall 12 serves as the means for reducing radiation of RF waves in the immediate direction of the user of a portable communications device equipped with the antenna. The shield wall 12 is desirably formed of a section of a cylinder having a concave curve relative to the conducting rod 2 and is generally straight along its length. The shield wall 12 has a length and a width that are sufficient to extend beyond the length and width of the conducting rod 2 to form a protective barrier.

The shield wall 12 and the bud 10 are formed from a metal, ceramic or other material that has the property of reflecting/deflecting or absorbing the RF radiation or electromagnetic energy transmitted by communications devices. Alternatively, the shield wall 12 and the bud 10 can be made from any material that is then coated or treated with a reflective/deflective or absorbing substance. Such materials or substances are well known and will be obvious to one skilled in the field. The shield wall 12 and bud(s) 10 can be molded as a single unit or they can be made separately and bonded together with an adhesive or by any other appropriate bonding process.

The bud 10 portion of the directing shield 4 is also depicted in FIGS. 2 through 9. One or more buds 10 serve as a means for reducing RF radiation emitted from a communications device in the direction of a near bystander. Referring to the directing shield of FIG. 3, a bud 10, coupled with the shield wall 12, form a semi-conic channel having a large upper aperture 14 and smaller lower aperture 16. A cross-section of the bud 10, taken along line 8A—8A of FIG. 8, is shown in FIG. 8A.

With regard to the semi-conic channel, the side of the bud 10 proximate to the shield wall 12 forms a posterior arc 18 that is concave with respect to the channel 8 within the bud 10. The side of the bud 10 opposite the shield wall 12 forms an anterior arc 20 that is also concave with respect to the channel 8. The anterior arc 20 relative to the smaller lower aperture 16 has a radius that is smaller than the anterior arc 20 relative to the large upper aperture 14. In addition, the radius of the anterior arc 20 relative to the large upper aperture 14 is smaller than the radius of the posterior arc 18. In the preferred embodiment, the posterior arc 18 is formed by the concave curve of the shield wall 12.

In general, the shield wall 12 is parallel to the rod 2 along the shield wall 12. In addition, the relative sizes of the large upper aperture 14 and smaller lower aperture 16 of the bud 10 structure form a bud angle 22 (see FIG. 9) between the exterior surface of the bud 10 relative to the central longitudinal axis of the rod 2 in the channel 8. Preferably, the bud angle 22 formed is in a range between 10 and 60 degrees.

FIGS. 2 and 7 through 9 depict a directing shield 4 having multiple buds 10. As shown, the buds are arranged in a cascade fashion so that each predecessor bud 10P partially overlaps a successor bud 10S such that the successor bud's 10S smaller lower aperture 16 is within the channel 8 of the predecessor bud 10P through the large upper aperture 14 of the predecessor bud 10P.

In the preferred embodiment of the device, the shield wall 12 extends above the posterior arc 18 of the outer most bud 10M or the only bud 10 for a single bud 10 design to form a shield wall extension 24. The shield wall extension 24 provides additional protection for the user from RF radiation reflecting from the outer most bud 10M.

The preferred embodiment of the invention also has an outer shell 6 which serves as a means to protect, bind, and insulate the directing shield 4 and rod 2. Essentially, the rod 2 resides within the channel 8 of the directing shield 4 with the tip 7 of the rod 2 between the smaller lower aperture 16 and large upper aperture 14 of the outer most bud 10. In the channel 8, the rod 2 is offset from the shield wall 12 and directing bud 10 and thus, does not contact either. This arrangement is then encased within the outer shell 6 such that the material of the outer shell 6 fills the space between the directing shield 4 and rod 2 and insulates the directing shield 4 from the rod 2. One method to make such an embodiment includes the placement of the rod 2 and directing shield 4 into a holder member that holds the positions of the rod 2 and directing shield 4 respectively. The rod 2 and directing shield 4 are then placed into a mold with the material for the outer shell 6 in a fluid state and removed when the material has solidified.

One appropriate material for the outer shell 6 includes plastic or resin. Any other appropriate material may be used. However, since the outer shell 6 contains the rod 2, the material must not have a property that would reflect or impede the transmission of RF radiation. In addition, if no separate insulator is used on the rod 2, the material for the outer shell 6 must have the property of insulating the rod from making electrical contact with the directing shield 4. This property would not be necessary if the material for the directing shield 4 is made from a non-conductor. There are many other means for protecting or binding the directing shield 4 and the rod 2, which will be obvious to one skilled in the field.

While the outer shell 6 generally encloses the rod 2, the outer shell 6 must allow for a connection between the rod 2 and the circuitry of the communications device. There are many ways to so encase the conducting rod 2, which will be obvious to one skilled in the field. In the embodiment depicted in FIG. 1, the rod 2 extends out from the outer shell 6. Consistent with the objectives of the present invention, the threaded connector would be shielded within the communications device to prevent it from emitting RF radiation.

Figure 15:
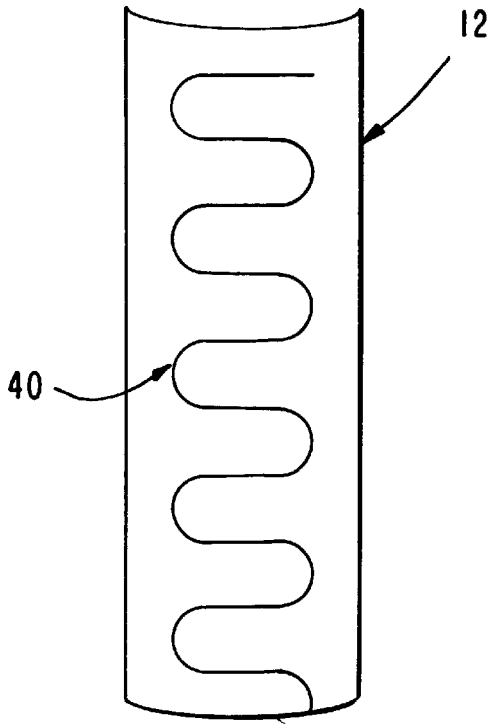
FIG. 15 shows an embodiment of the shield wall with a receiver member.

In an alternative embodiment, a separate receiver member 40, shown in FIG. 15, is added to the antenna A on the side of the shield wall 12 opposite the rod 2. Thus, the receiver member is outside the channel 8 (not shown). Consistent with the principles of the invention, the receiver member 40, which is a conductor that may have various configurations, is used as a conductor for receiving RF signals. The receiver member 40 is not used to transmit RF signals.

Figure 14:
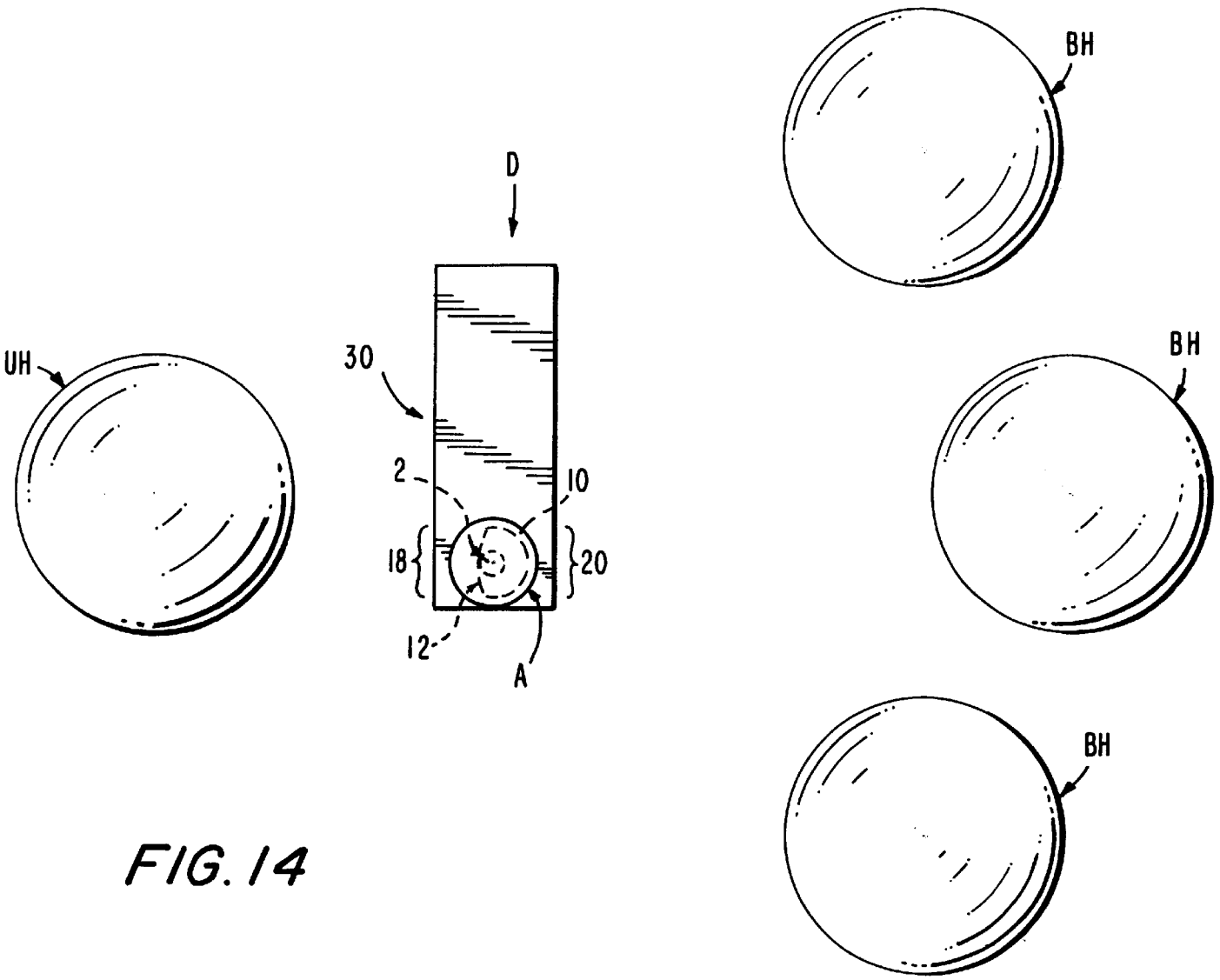
FIG. 14 is a top view showing the positions of a user and bystanders in relation to a directing shield.

In FIG. 14, the relative positioning of the antenna A with respect to a user's head and bystander's head is shown. In general, when on a communications device D in use, the antenna A is arranged adjacent to the user face (30) of the device D so that the shield wall 12 within the antenna A is positioned between the user head UH and the rod 2. In this way, the anterior arc 20 of the bud(s) 10 on the opposing side of the rod 2 is adjacent to a second face of the device D and is between a bystander head BH and the rod 2. Furthermore, the antenna A should be positioned so that a central longitudinal antenna axis C through the rod 2 is approximately vertical during use. In this configuration, the transmission of RF radiation is directed vertically minimizing exposure of the user UH and any bystander head BH near the device.

Figure 10:
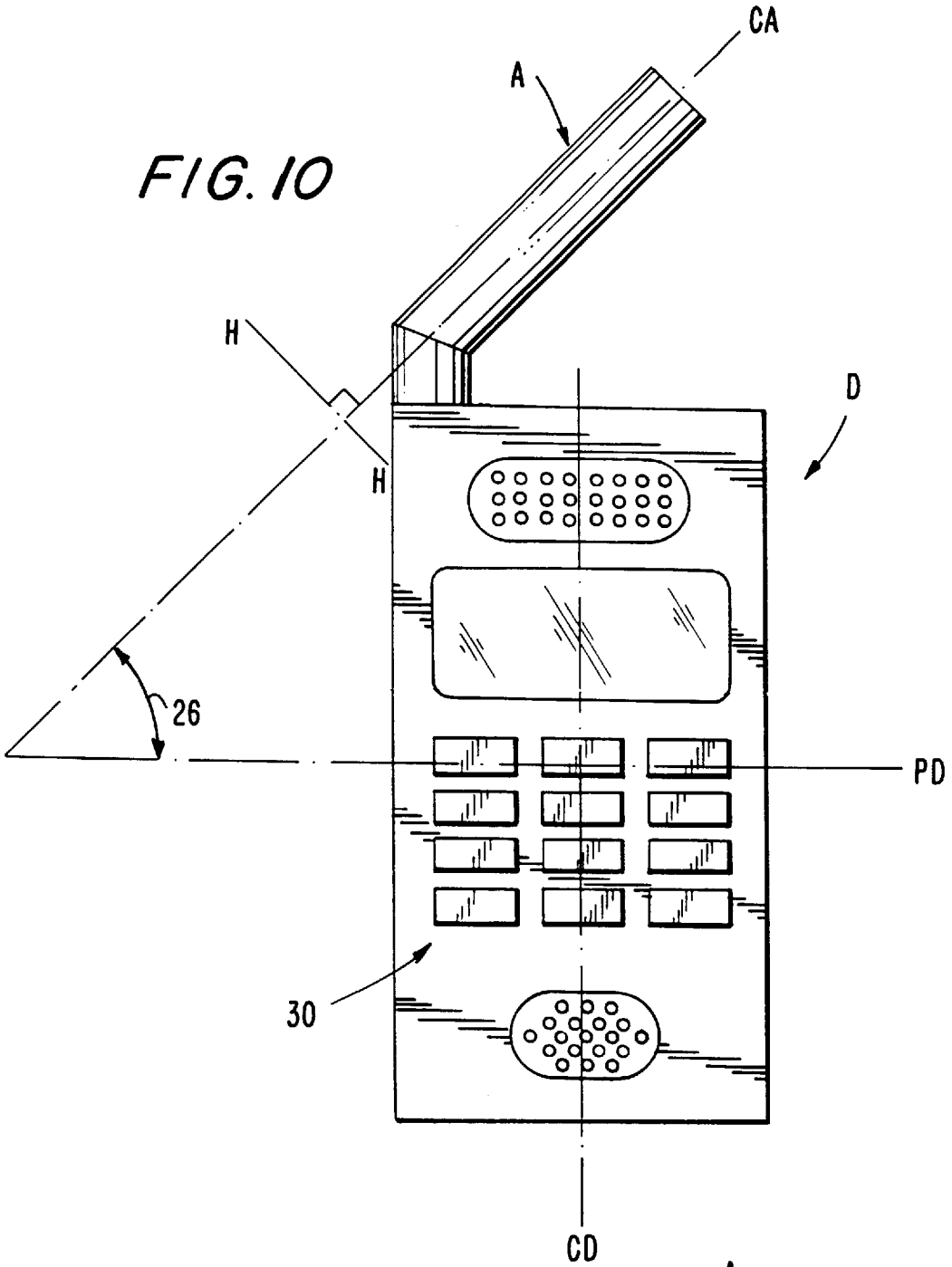
FIG. 10 is a front view of a communications device with an alternative embodiment of the antenna of FIG. 1.
Figure 11:
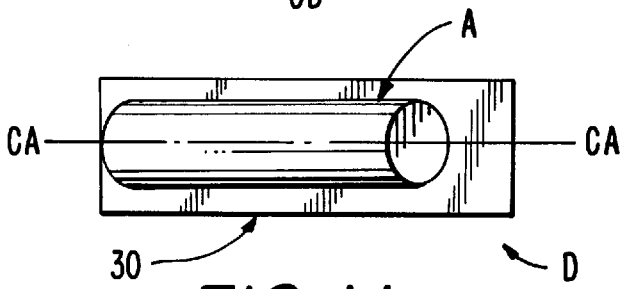
FIG. 11 is a top view of the communications device of FIG. 10.

FIGS. 10 through 13 show various embodiments of the invention attached to a communications device D. Consistent with the invention's principles, in FIGS. 10 and 11, the antenna A is positioned at a bend angle 26 to promote vertical use when the communications device D is used. In FIG. 10, the antenna is approximately vertical with respect to the horizon line H—H. FIG. 10 also shows a central longitudinal axis of the communications device CD with a perpendicular axis PD thereto. The bend angle 26 formed by the angle between the perpendicular axis PD and the antenna axis C is in the range of 45 to 75 degrees with the preferred bend angle 26 being set at 60 degrees.

When antenna A has a bend angle such as that depicted in FIG. 10, the antenna A must be configured for either left hand or right hand users. In this regard, the antenna A of FIG. 10 is a left hand antenna. This ensures that the shield wall 12 within the antenna A will remain between the user and rod 2.

Figure 12:
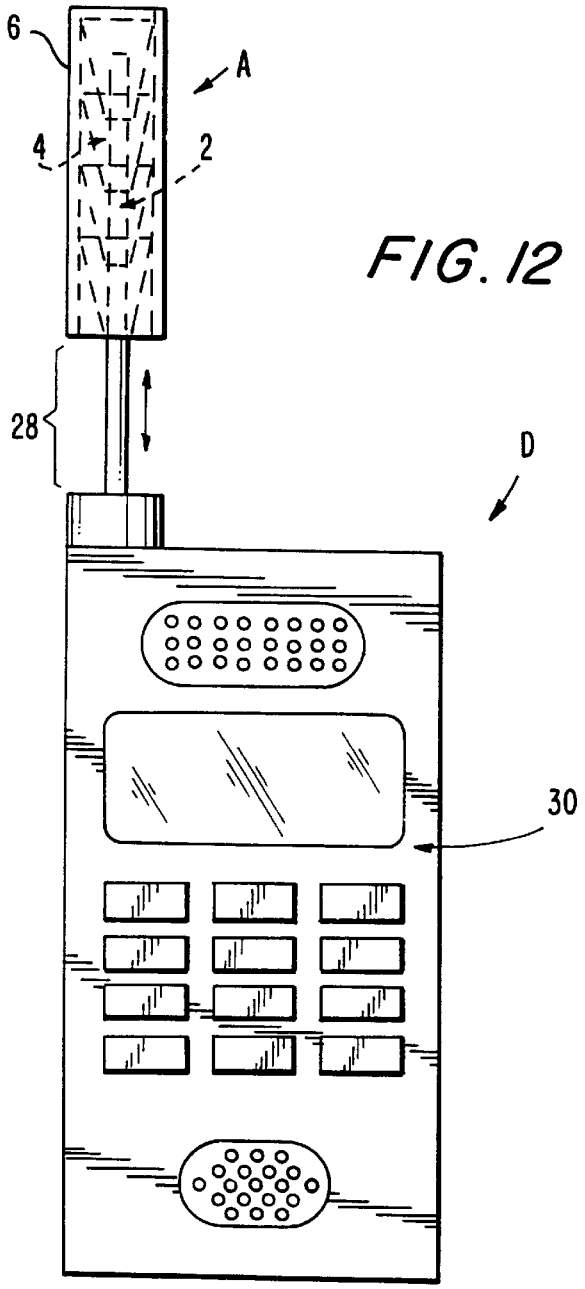
FIG. 12 shows a communications device with an alternative embodiment of the antenna of FIG. 1.

FIG. 12 shows an extendible antenna A. The outer shell 6 with encased directing shield 4 and rod 2 can extend away from the communications device D. When extended, the antenna A has an antenna extension 28. The antenna extension houses the means for connection between the circuitry of the communications device D and the rod 2 of the antenna A. The antenna extension 28 is treated or made from a reflective/deflective or absorptive material to prevent transmission of RF energy outward from it.

Figure 13:
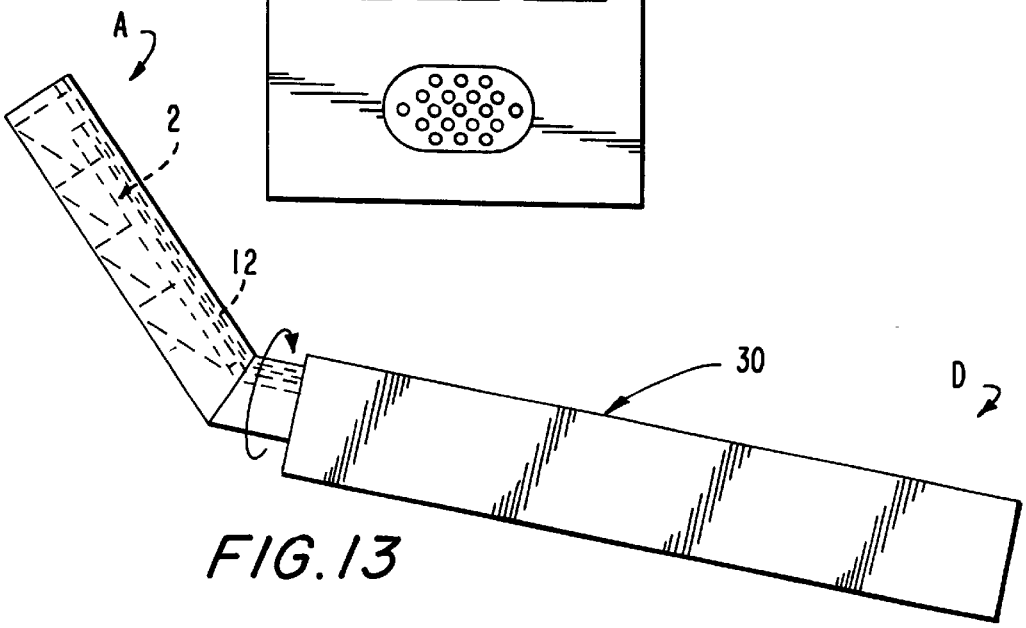
FIG. 13 is a side view of the communications device of FIG. 10.

FIG. 13 depicts the antenna A of FIG. 10 with a swivel feature used on a display-only communications device D. With the assistance of the swivel, the antenna A can be positioned to maintain a vertical alignment of the rod 2 while the communications device D is used as, for example, an internet access device. The swivel permits the shield wall 12 to remain between the user and the rod 2 when the communication device D is used in a horizontal position. The arc of the swivel in one embodiment may be limited to restrict the antenna to about a 90 degree turn and may lock in various positions within the arc.

Although the invention has been described with reference to particular embodiments, it is to be understood that these embodiments are merely illustrative of an application of the principles of the invention. Numerous modifications, in addition to the illustrative embodiments of the invention discussed herein may be made and other arrangements may be devised without departing from the spirit and scope of the invention.

We claim:

1. An antenna in combination with a hand-held portable communications device comprising:

a conducting member with anterior and posterior sides along the length of said conducting member and a tip end;

a posterior shield positioned along said posterior side of said conducting member; and an angled shield positioned along said anterior side of said conducting member;

wherein said posterior shield and said angled shield being positioned to form a channel for encompassing said conducting member;

wherein said posterior shield is positioned adjacent to a user face of the communications device; and wherein said angled shield is positioned adjacent to a second face of the communications device.

2. The antenna of claim 1 further comprising:

an outer shell substantially encasing said posterior shield, said angled shield and said conducting member.

3. The antenna of claim 2 wherein said posterior shield is semi-cylindrical in shape.

4. The antenna of claim 3 wherein said posterior shield has a concave curve relative to said channel.

5. The antenna of claim 4 wherein said angled shield comprises a semi-conic structure.

6. The antenna of claim 5 wherein said semi-conic structure has a large aperture and small aperture and the angle formed along the central longitudinal axis of the said conducting member and an axis from said conducting member along the surface of said semi-conic structure from said small aperture to the large aperture is in the range of 10 to 60 degrees.

7. The antenna of claim 6 wherein the radius of said large aperture is smaller than the radius of the concave curve of said posterior shield.

8. The antenna of claim 7 wherein said angled shield further comprises a plurality of semi-conic structures.

9. The antenna of claim 8 wherein said plurality of semi-conic structures are cascaded with the small aperture of each semi-conic structure extending through a large aperture of a next adjacent semi-conic structure.

10. The antenna of claim 9 wherein said tip end of said conducting member is within said channel of an outer semi-conic structure.

11. The antenna of claim 10 wherein said posterior shield extends beyond the large aperture of the outer semi-conic structure.

12. The antenna of claim 7 further comprising a swivel member wherein said conducting member, said posterior shield and said angled shield and said outer shell swivel with respect to said communications device.

13. The antenna of claim 7 wherein a central longitudinal axis along said conducting member forms a bend angle with respect to a perpendicular to a central longitudinal axis of said communications device in the range of 45 to 75 degrees.

14. The antenna of claim 13 wherein said bend angle is 60 degrees.

15. The antenna of claim 7 further comprising a swivel member wherein said conducting member, said posterior shield and said angled shield and said outer shell swivel with respect to said communications device.

16. The antenna of claim 7 wherein a central longitudinal axis along said conducting member form bend angle with respect to a perpendicular to a central longitudinal axis of said communications device in the range of 45 to 75 degrees.

17. The antenna of claim 16 wherein said bend angle is 60 degrees.

18. The antenna of claim 1 further comprising a receiving member positioned outside said channel.

19. An antenna combined with a hand-held portable communications device comprising:

a conducting member with anterior and posterior sides along the length of said conducting member and a tip end;

a semi-cylindrical posterior shield positioned along said posterior side of said conducting member;

an angled shield positioned along said anterior side of said conducting member; and an outer shell substantially encasing said posterior shield, said angled shield and said conducting member.

wherein said posterior shield and said angled shield form a channel for said conducting member;

wherein said angled shield comprises a plurality of semi-conic structures each with a large aperture and small aperture and an angle formed along the central longitudinal axis of the said conducting member and an axis from said conducting member along the surface of each said semi-conic structure from said small aperture to the large aperture is in the range of 10 to 60 degrees and said plurality of semi-conic structures are cascaded;

wherein said tip end of said conducting member is within said channel of an outer semi-conic structure;

wherein said posterior shield extends beyond the large aperture of the outer semi-conic structure;

wherein said posterior shield is positioned adjacent to a user face of the communications device; and wherein said angled shield is positioned adjacent to a second face of the communications device.

20. The antenna of claim 19 further comprising a receiver member positioned outside said channel.

21. An antenna for a hand-held portable communications device comprising:

a conducting member with an anterior and posterior sides along the length of said conducting member and also with a tip end;

a posterior shield positioned along said posterior side of said conducting member;

an angled shield positioned along said anterior side of said conducting member; and an outer shell substantially encasing said posterior shield, said angled shield and said conducting member, wherein said posterior shield and said angled shield form a channel for said conducting member.

22. The antenna of claim 21 further comprising a receiver member positioned outside said channel.

23. The antenna of claim 21 wherein said posterior shield is semi-cylindrical in shape.

24. The antenna of claim 21 wherein said posterior shield has a concave curve relative to said channel.

25. The antenna of claim 24 wherein said angled shield comprises a semi-conic structure.

26. The antenna of claim 25 wherein said semi-conic structure has a large aperture and small aperture and the angle formed along the central longitudinal axis of the said conducting member and an axis from said conducting member along the surface of said semi-conic structure from said small aperture to the large aperture is in the range of 10 to 60 degrees.

27. The antenna of claim 26 wherein the radius of said large aperture is smaller than the radius of the concave curve of said posterior shield.

28. The antenna of claim 27 wherein said angled shield further comprises a plurality of semi-conic structures.

29. The antenna of claim 28 wherein said plurality of semi-conic structures are cascaded with the small aperture of each semi-conic structure extending through a large aperture of a next adjacent semi-conic structure.

30. The antenna of claim 29 wherein said tip end of said conducting member is within said channel of an outer semi-conic structure.

31. The antenna of claim 30 wherein said posterior shield extends beyond the large aperture of the outer semi-conic structure.

32. The antenna of claim 31 further comprising a swivel member wherein said conducting member, said posterior shield and said angled shield and said outer shell swivel with respect to said communications device.

33. The antenna of claim 32 wherein a central longitudinal axis along said conducting member forms a bend angle with respect to a perpendicular to a central longitudinal axis of said communications device in the range of 45 to 75 degrees.

* * * * *